US006447067B1

(12) United States Patent
Williams et al.

(10) Patent No.: US 6,447,067 B1
(45) Date of Patent: Sep. 10, 2002

(54) SEATING UNIT HAVING BACK SCREEN

(75) Inventors: Otto N. Williams, San Francisco; Jon H. LeFors, Burlingame; Jess A. Sorel, Oakland, all of CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/872,520

(22) Filed: Jun. 1, 2001

(51) Int. Cl.[7] ..... B60W 2/48
(52) U.S. Cl. ..... 297/377; 297/184.11
(58) Field of Search ..... 297/184.11, 184.1, 297/184.15, 188.04, 354.1, 354.12, 377; 135/16, 90, 115, 117, 120.1

(56) References Cited

U.S. PATENT DOCUMENTS 1,923,517 A * 8/1933 Swanniger ..... 155/117
D230,918 S 3/1974 Andrus
3,826,533 A 7/1974 Andrus et al.
4,084,849 A * 4/1978 Ishida et al. ..... 297/22
4,230,363 A * 10/1980 Borichevsky ..... 297/184
4,641,837 A * 2/1987 Ruth ..... 272/123
5,154,473 A * 10/1992 Joranco ..... 297/184
5,203,363 A * 4/1993 Kidwell et al. ..... 135/90
5,342,114 A * 8/1994 Burke et al. ..... 297/344.2
5,873,625 A * 2/1999 Uchtman ..... 297/184.15

* cited by examiner

*Primary Examiner*—Peter M. Cuomo
*Assistant Examiner*—Stephanie Harris
(74) *Attorney, Agent, or Firm*—Price Heneveld Cooper Dewitt & Litton

(57) ABSTRACT

An assembly includes a seating unit, and a pair of legs. The legs each engage and support a bottom of the seating unit, and include a protruding attachment member that slides mateably into a pocket in a rear of the seating unit. When the fasteners are installed, the protruding attachment member cannot be removed from the pocket. By this arrangement, the protruding attachment member and pocket form part of a retaining structure for retaining the leg to the seating unit. A back screen releasably fits between the leg and the back, and is retained by the protruding attachment member against the back. The screen can be shipped disassembled from the seating unit, and assembled on site to provide a privacy function while complimenting the chair's architectural appearance.

18 Claims, 9 Drawing Sheets

SEATING UNIT HAVING BACK SCREEN

BACKGROUND

The present invention relates to seating units designed for comfort, privacy, and efficient assembly, and more particularly relates to a lounge chair having a releasably attached back screen and legs, either one of which can be shipped in a knocked-down condition and assembled on site. Notably, it is contemplated that the present invention is not limited just to lounge chairs.

Lounge chairs are often used in public areas, such as in airports, business lobbies, and common areas in office buildings, to provide comfortable open seating. However, even in public areas, users often want a degree of visual privacy so that they can socialize and/or work with a sense of enclosure. A problem is that most lounge chairs are not intended and do not provide good visual privacy, since they have relatively low backs and arms, and also they are often placed away from building walls. As a result, people moving around will often come up on a seated person's backside and be able to disturb their activity or concentration. It is desirable to provide lounge chairs that are flexibly constructed to satisfy a wide range of visual privacy needs without major compromise of the seating elements. Further, it is desirable that the level of privacy be able to be specified to fit the customer's application.

In addition to and as part of the above, it is desirable to provide a chair assembly that can be knocked down and shipped as a dense package. At the same time, on-site assembly of components must be very easy, require few tools, involve few pieces, and provide a low chance of damaging chair components during on-site in-the-field assembly.

Another challenge is that many consumers want a high-quality, modern architectural "look" with flat surfaces, sharp lines, and "clean, crisp" edges and joints. Flat surfaces, sharp linear lines, and "clean, crisp" edges are not easily made consistent unless a sturdy support frame is provided for cushions, since cushion edges tend to break down and collapse over time, particularly with heavy use. However, sturdy support frames can be expensive. Still further, consumers want the ability to arrange and rearrange the seating units in different patterns, which requires not only light weight but also a style that permits chairs to be arranged in a range of configurations. It is not immediately apparent how to combine these different functional requirements into a single seating system, nor how to satisfy the need for rearrangeability.

Accordingly, an article and method are desired solving the aforementioned problems and having the aforementioned advantages.

SUMMARY OF THE PRESENT INVENTION

In one aspect of the present invention, a seating unit assembly includes a seating unit, and a leg engaging a bottom and a back of the seating unit. The leg includes a protruding attachment member that releasably engages a pocket in the seating unit when the leg is attached to the seating unit. At least one fastener attaches the leg to the seating unit at a location spaced from the protruding attachment member so that, when the fastener is installed, the protruding attachment member cannot be removed from the pocket. By this arrangement, the protruding attachment member and pocket form part of a retaining structure for retaining the seating unit to the leg.

In another aspect of the present invention, a seating unit assembly includes a seating unit, and a leg attached to and supporting the seating unit. A back screen is attached to the seating unit and retained, at least in part, by the leg. The back screen extends upwardly from a rear of the seating unit so that the back screen visually shields a seated person in the seating unit when the seating unit is viewed from a position behind the chair.

In yet another aspect of the present invention, a method of shipping and assembling a seating unit comprises steps of providing a seating unit having a rear, providing a leg shaped to support the seating unit and including an attachment member oriented to releasably engage the rear, and providing a back screen shaped to lie against the rear and fit between the rear and the attachment member. The method further includes shipping the back screen in a condition unattached to the seating unit, positioning the back screen against the rear of the seating unit and between the seating unit and the attachment member, and attaching the leg to the seating unit to, at least in part, hold the back screen in position on the seating unit.

In yet another aspect of the present invention, a method includes steps of providing a seating unit with a back portion, and attaching a back screen to the back portion that extends above the back portion to create a visual screen that separates a seated user from persons behind the seating unit.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
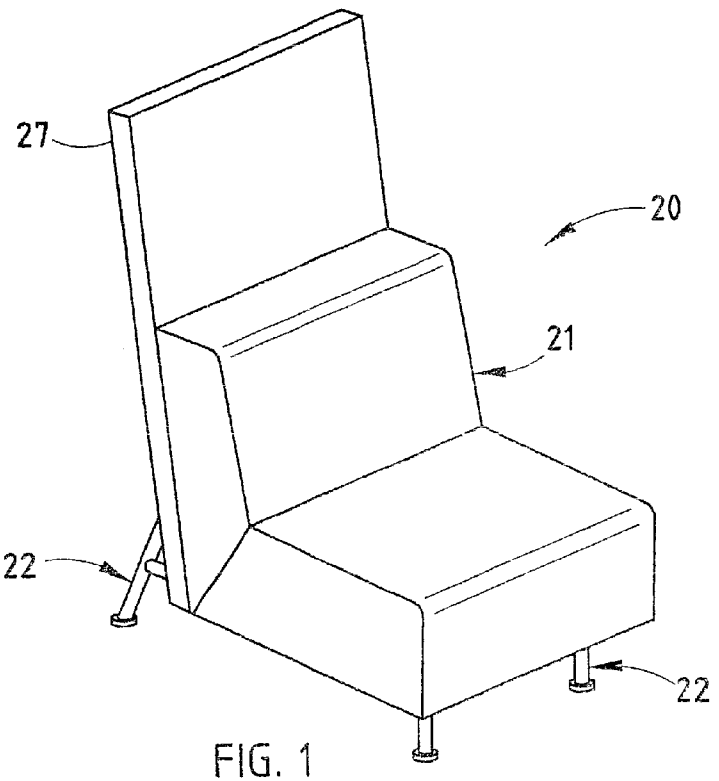
Figure 4:
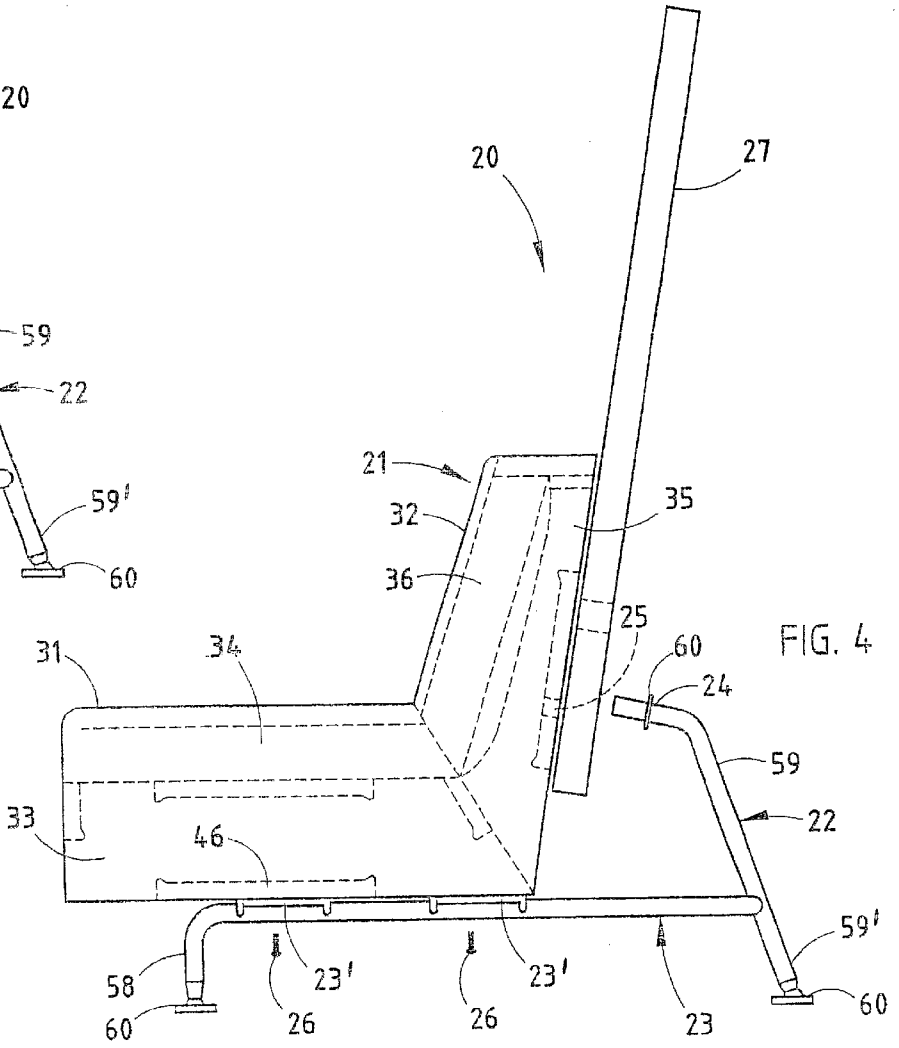
FIGS. 3–5 are side views of the seating unit assembly in FIG. 1, FIG. 3 showing the legs exploded away from the seating unit, FIG. 4 showing the back screen partially positioned between the back portion of the seating unit and the upright of the legs, and FIG. 5 showing the seating unit assembly fully assembled with the back screen in place.
Figure 5:
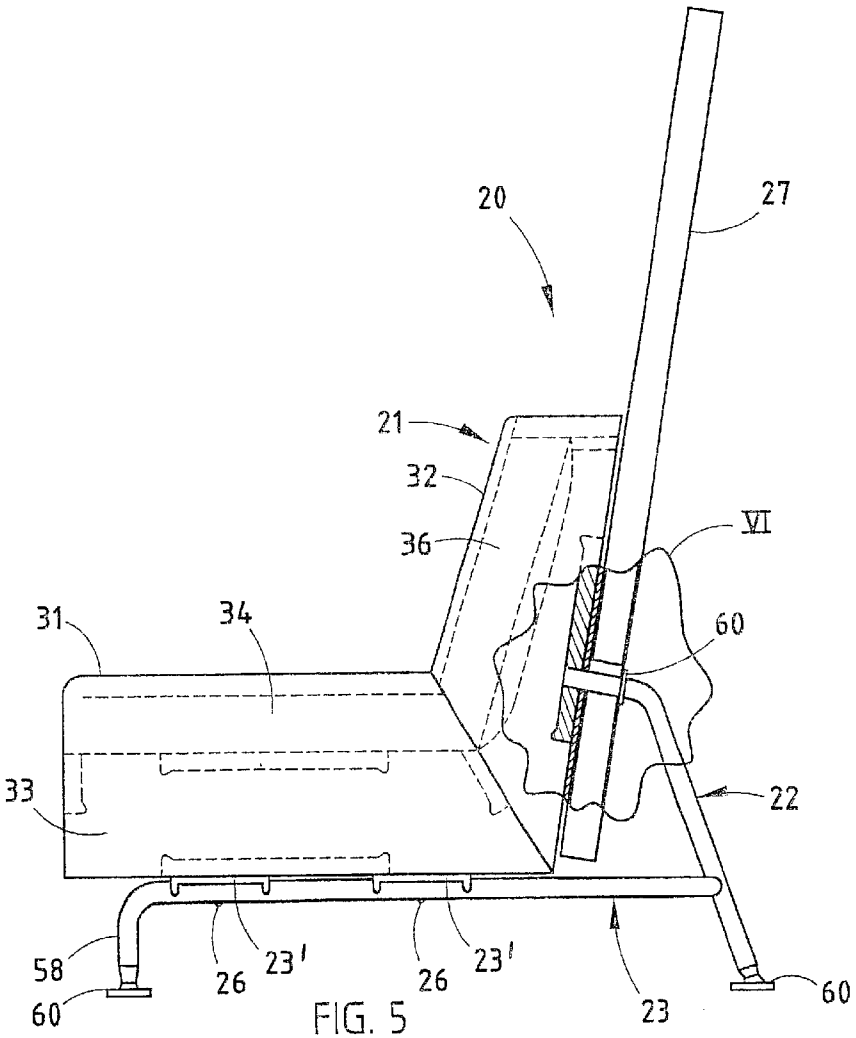

A lounge chair (also hereafter called a seating unit assembly 20) (FIG. 1) includes a seating unit 21, and a pair of legs 22. The legs 22 each include a flat portion 23 (FIG. 5) interconnected by transverse channels 23' that engage and support a bottom of the seating unit 21, and further include a protruding attachment member 24 with an end that slides mateably into a pocket 25 in the back of the seating unit 21. Two pairs of threaded fasteners 26 attach the leg 22 to a bottom of the seating unit 21. When the fasteners 26 are installed, the protruding attachment member 24 cannot be removed from the pocket 25. By this arrangement, the protruding attachment member 24 and pocket 25 form part of a retaining structure for retaining the legs 22 to the seating unit 21. A back screen 27 is provided that can be optionally fit against a rear of the seating unit 21 between the legs 22 and the back of the seating unit 21. The back screen 27 is retained by the protruding attachment member 24 against the back. The arrangement permits the back screen 27 to be shipped in a knocked-down condition separate from the seating unit 21, and to be selectively assembled on site. Additionally, attachment of the back screen 27 further provides a very distinctive alternative appearance, as well as provides the function of partial screening around the seating unit assembly 20.

The illustrated seating unit 21 includes thick cushions to provide a lounge-type seating often found in reception areas, public areas, meeting areas, and the like. However, it is contemplated that many of the present concepts, such as the back screen concept and the one-screw leg attachment concept, can be used in a wide variety of situations, such as on office chairs, public seating, and the like.

Figure 3:
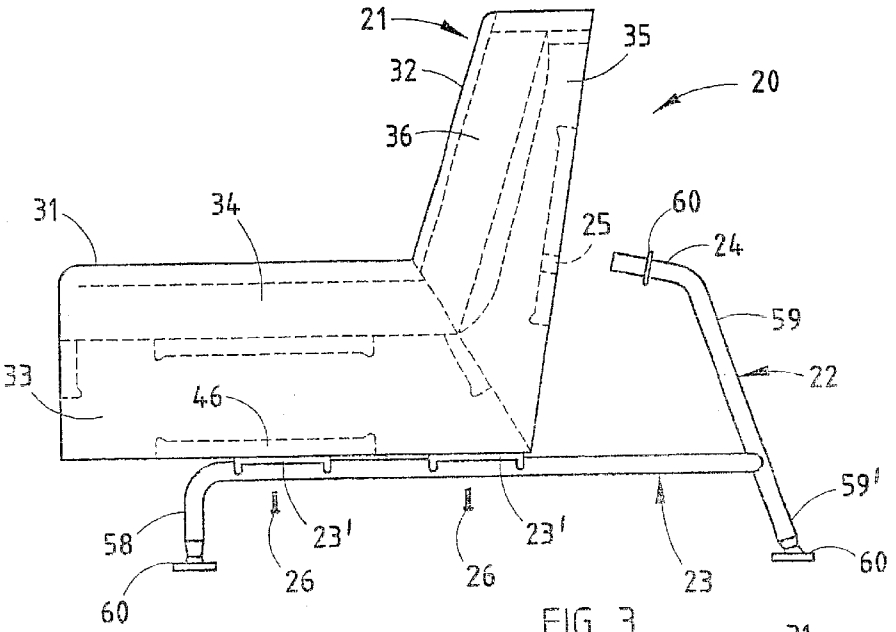
Figure 6:
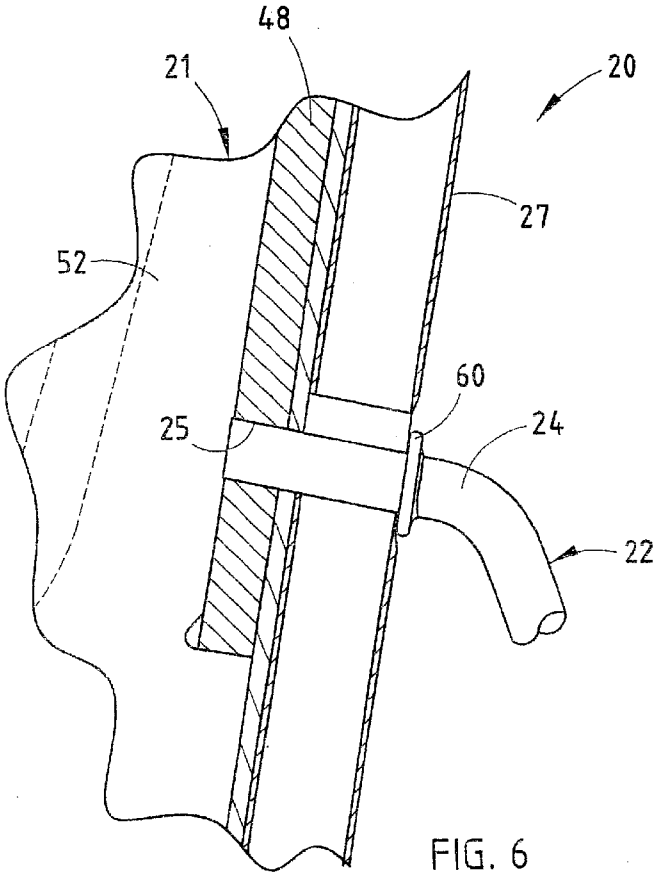
FIG. 6 is an enlarged view of the circled area VI in FIG. 5.
Figure 7:
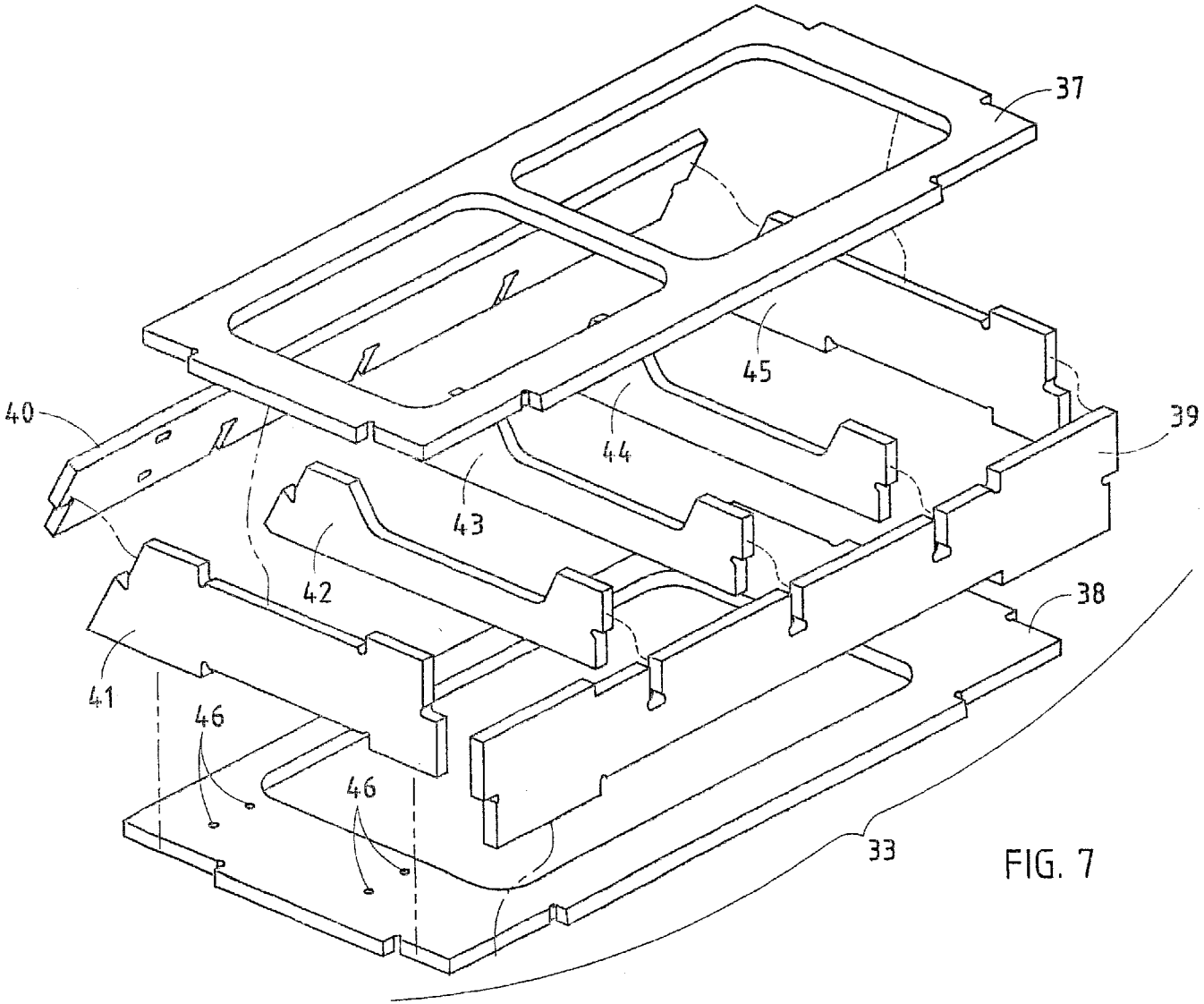
FIGS. 7–8 are exploded perspective views of the seat frame and back frame of the seating unit assembly of FIG. 1.
Figure 8:
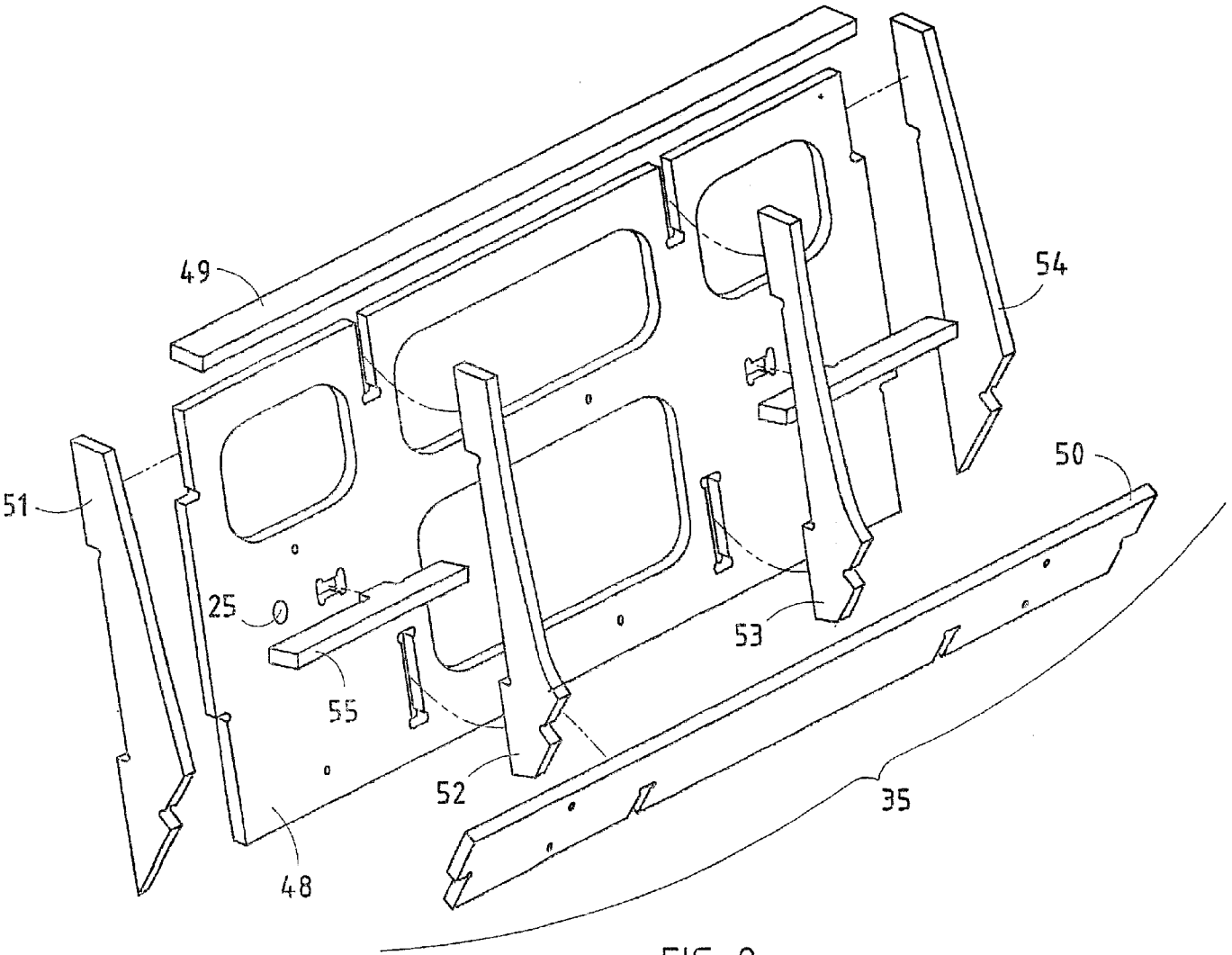

The seating unit 21 includes a seat portion 31 and a back portion 32. The seat portion 31 includes a seat frame 33 (FIG. 7) that supports a seat cushion 34 (FIG. 3) upholstered onto the frame 33, and the back portion 32 (FIG. 8) includes a back frame 35 that supports a back cushion 36 (FIG. 3) upholstered onto the frame 35. The seat portion 31 and the back portion 32 have box-like shapes, and include multiple flat surfaces with relatively square and sharp corners, which provides a clean and crisp appearance sometimes referred to as "an architectural look". It is noted that the panel-like back screen 27, when attached to the back, compliments this architectural look.

Figure 9:
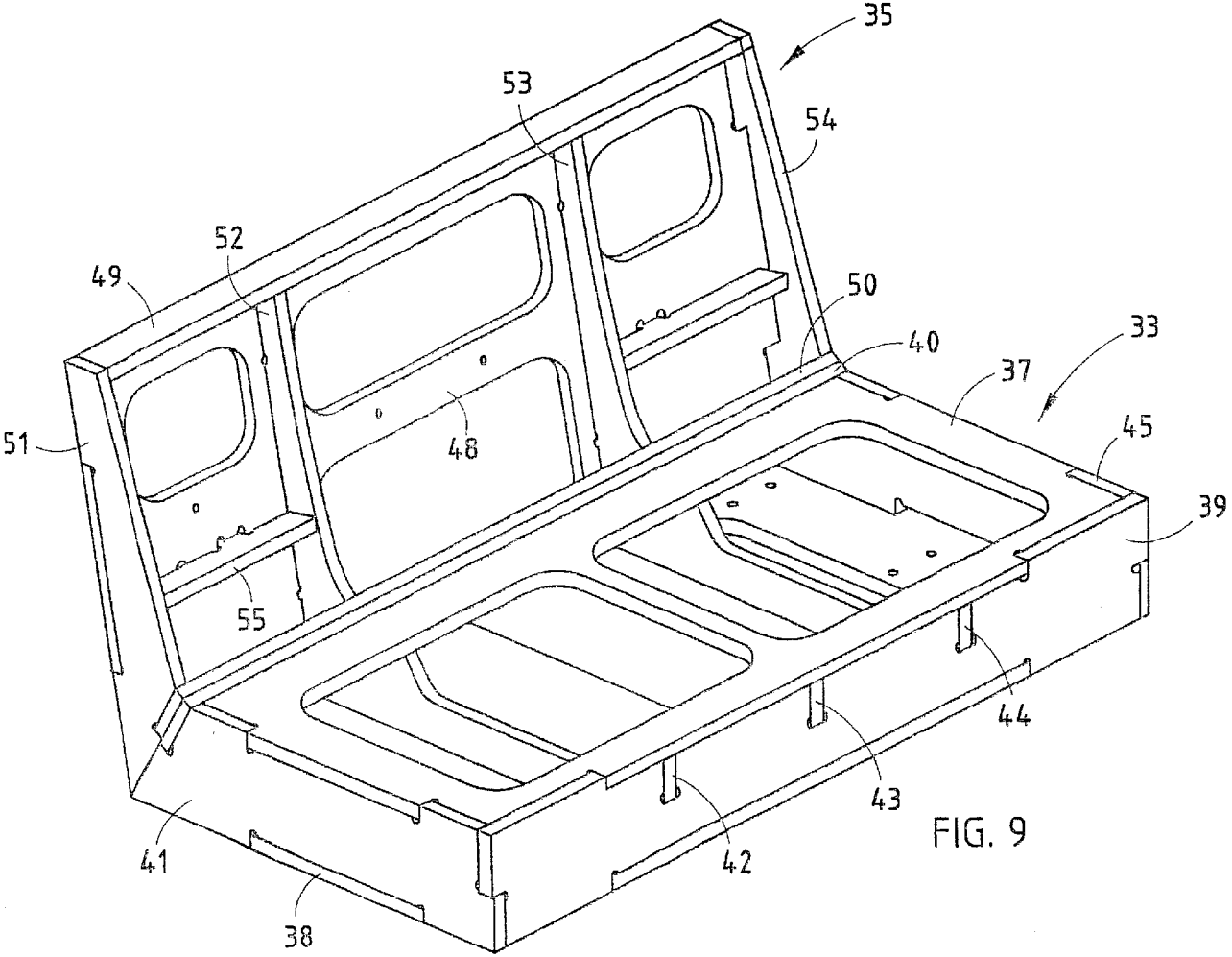
FIG. 9 is a perspective view of the assembled seat and back frames of FIGS. 7–8.

The seat frame 33 (FIG. 7) is made of a plurality of wooden or composite boards, including top and bottom apertured panels 37 and 38, interconnected by front and rear boards 39 and 40, and by a plurality of horizontal cross supports 41–45. All components 37–45 include tongues and mating grooves that inter-fit together (FIG. 9). The assembly is secured by mechanical and/or adhesive means, such as by staples, nails, glue, or other ways known in the art. Additionally, the bottom apertured panel 38 includes holes and inserted T-nuts 46 for receiving the fasteners 26.

The back frame 35 (FIG. 8) is also made of a plurality of wooden or composite boards, and includes a rear apertured panel 48, top and bottom boards 49 and 50, and by a plurality of vertical cross supports 51–54. A secondary board 55 is attached to panel 48 for stiffening, and also board 55 covers pocket 25 to prevent member 24 from traveling through pocket 25. Most components 48–54 include tongues and mating grooves that inter-fit together, although this is not required, per se. The assembly is secured by mechanical and/or adhesive means, such as by staples, nails, glue, or other ways known in the art. Additionally, the rear apertured panel 48 includes the holes forming the pockets 25, which pockets are covered on a cushion-side front surface by cross supports 52 and 53 to limit over-travel of the attachment members 24 through the pockets 25.

It is noted that the frame 33/35 can be made longer for bench-type multi-person seating by extending a length of the seat and back frames. In such case, the seat and back frames include additional cross supports as needed, and additional legs are attached as desired.

Figure 10:
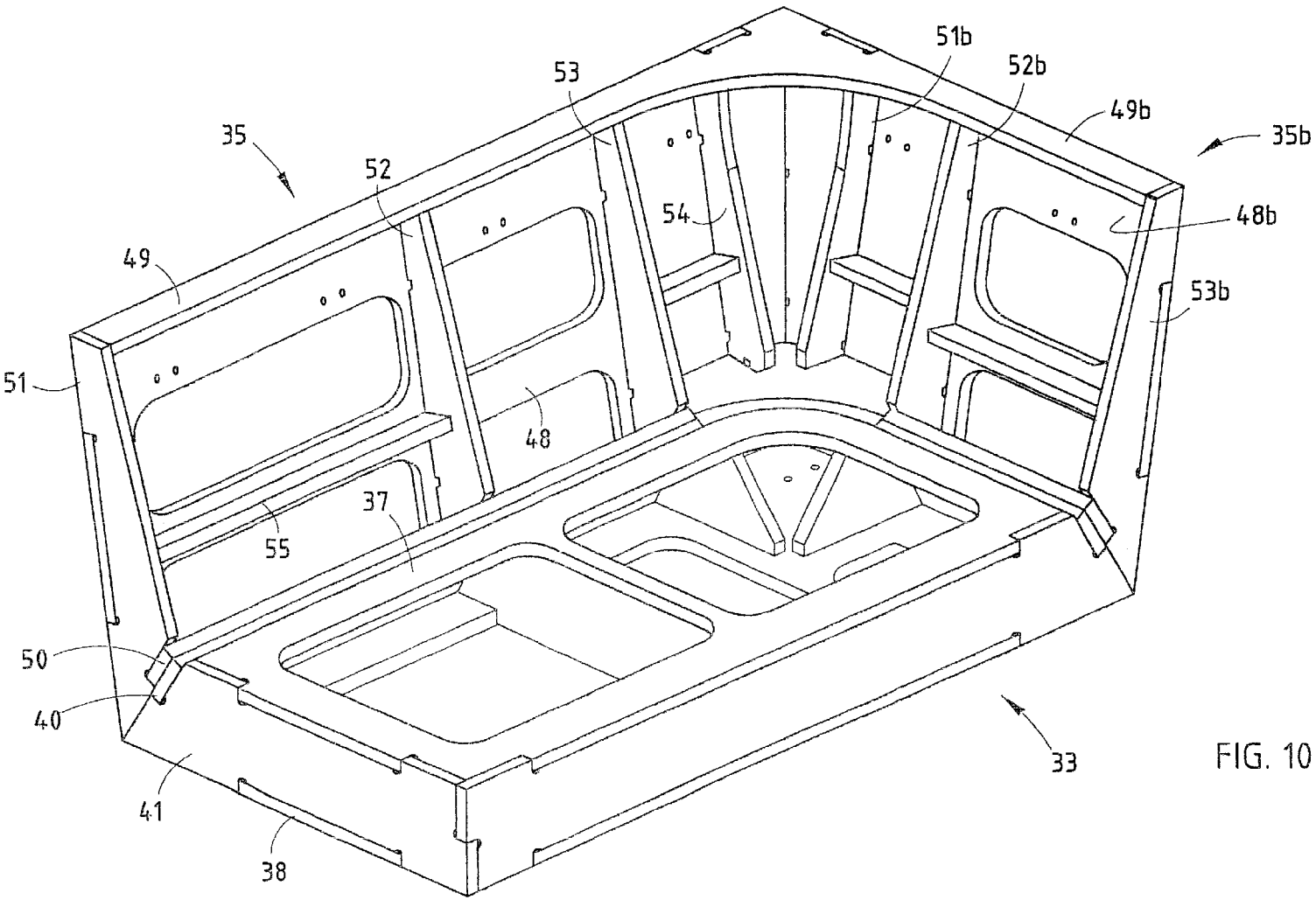
FIG. 10 is a perspective view of a frame for a modified "corner" seating unit assembly.

The "linear" seating unit assembly 20 can be modified to become a corner seating unit assembly 20A modifying the back frame 33/35 and by addition of a corner-forming back frame 35B. The illustrated corner seating unit assembly 20A (FIG. 12) utilizes tongue-and-grooved seat and back frames 33A and 35A that are very similar to the seat and back frames 33 and 35 of the linear seating unit assembly 20 (FIG. 10), but edges of the seat and back frames 33A and 35A are modified to mate with the corner-forming back frame 35B. The corner-forming back frame 35B includes a rear apertured panel 48B, top and bottom boards 49B and 50B, and by a plurality of vertical cross supports 51B–53B. The illustrated components 48B–53B include tongues and mating grooves that inter-fit together. The assembly is retained together and to seat and back frames 33B and 35B by known means, such as staples, nails, and glue. A corner back cushion is supported on a front of the corner back frame 32B.

The illustrated legs 22 (FIG. 3) are each a weldment of two bent J-shaped tubular sections and two channels 23'. The tubular sections include a flat portion 23 with a downwardly formed front end section 58, and also include an upright portion 59 with a lower/rear end section 59' and a forwardly bent top end section. Glides 60' are attached to the front and rear end sections 58 and 59 for engaging a floor surface. The protruding attachment member 24 is integrally formed from a front end of the top end section of the upright portion 59, and is oriented in a forward horizontal direction so that it engages the pocket 25 as the flat portion 23 engages and supports the bottom surface of the seat portion 31. Notably, the protruding attachment member 24 is at a slight angle to the flat portion 23, so that as the leg 22 is slid forwardly with the seating unit 21 resting on the flat portion 23, the attachment member 24 gradually engages the marginal material forming the pocket 25 with increasing downward force. By this arrangement, the back frame 35 is drawn against the leg 22 during assembly for secure retention. In turn, once the fastener screws 26 are installed through the legs 22 into the nuts 46, the seating unit 21 is secured to each leg 22 at both front and rear locations. It is contemplated that as many legs 22 can be attached to each seating unit 21 as are desired for the expected loading and use (or abuse) expected for the seating unit. In the illustrated arrangement, the leg 22 includes a washer or steel grommet 60 (FIG. 3) welded to the protruding attachment member 24 at a location so that it limits movement of the attachment member 24 into the pocket 25 and further so that it distributes stress around this joint to the back frame 35.

Figure 2:
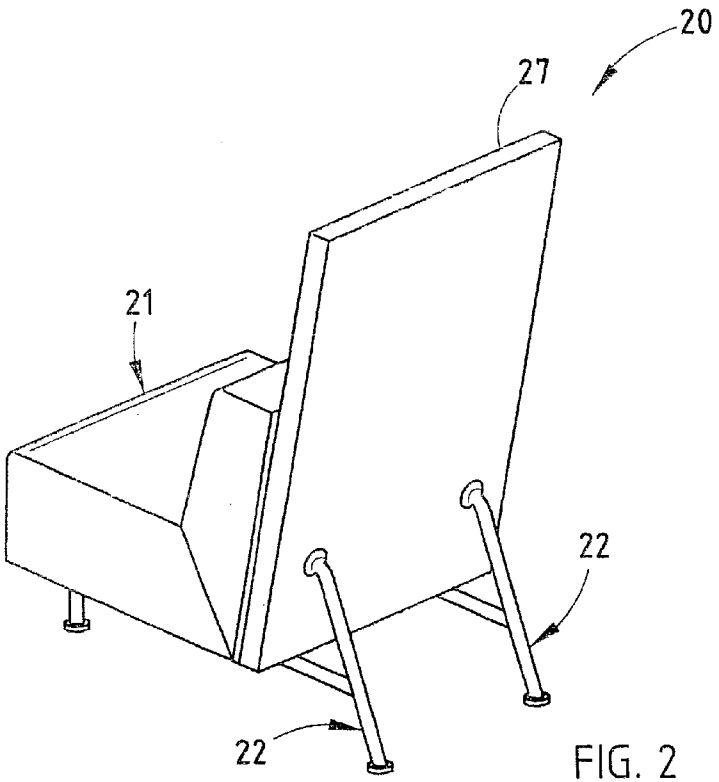
FIGS. 1–2 are front and rear perspective views of the present seating unit assembly with back screen.

The illustrated back screen 27 (FIG. 2) is a flat panel, such as a wood product (pressboard or plywood, for example), covered with upholstery or other covering. The back screen 27 includes a pair of holes 61 shaped to receive the attachment member 24 when the legs 22 are positioned for attachment. The illustrated back screen 27 includes a zipper 62 along two sides to facilitate adding the covering material over the back screen 27, but it is contemplated that a variety of different covering techniques can be used. For example, it is contemplated that back screens can be painted, stained, or otherwise covered instead of upholstered. Further, the back screen does not have to be a panel made of a wood product, but instead can be a translucent, transparent or opaque plastic, metal, composite, or other stiff material, and further can include a perimeter frame supporting an air-permeable screening material. The illustrated back screen 27 also includes a recess for receiving the washer 60 so that the washer 60 is located flush with the back when fully installed and attached. The particular back screen 27 shown is advantageous in that the lines formed by the back screen 27 are long and extend parallel existing lines on the seating unit assembly 20. Thus, the back screen 27 compliments the architectural look of the seating unit assembly 20.

To attach the back screen 27, screws 26 are loosened and legs 22 are moved rearwardly relative to the seating unit 21, (with the seating unit 21 still potentially resting on the legs 22). The back screen 27 is slipped between the upright portion of the legs 22 and screen 27 is slipped between the upright portion of the legs 22 and against a rear of the seating unit 21. The legs 22 are then moved forward with the protruding attachment members 24 being extended through the apertures 61 in the back screen 27 and into the pockets 25 in the seating unit 21. The fasteners 26 are then used to secure the legs 22 to the seating unit 21, with the back screen 27 clamped in place.

Figure 11:
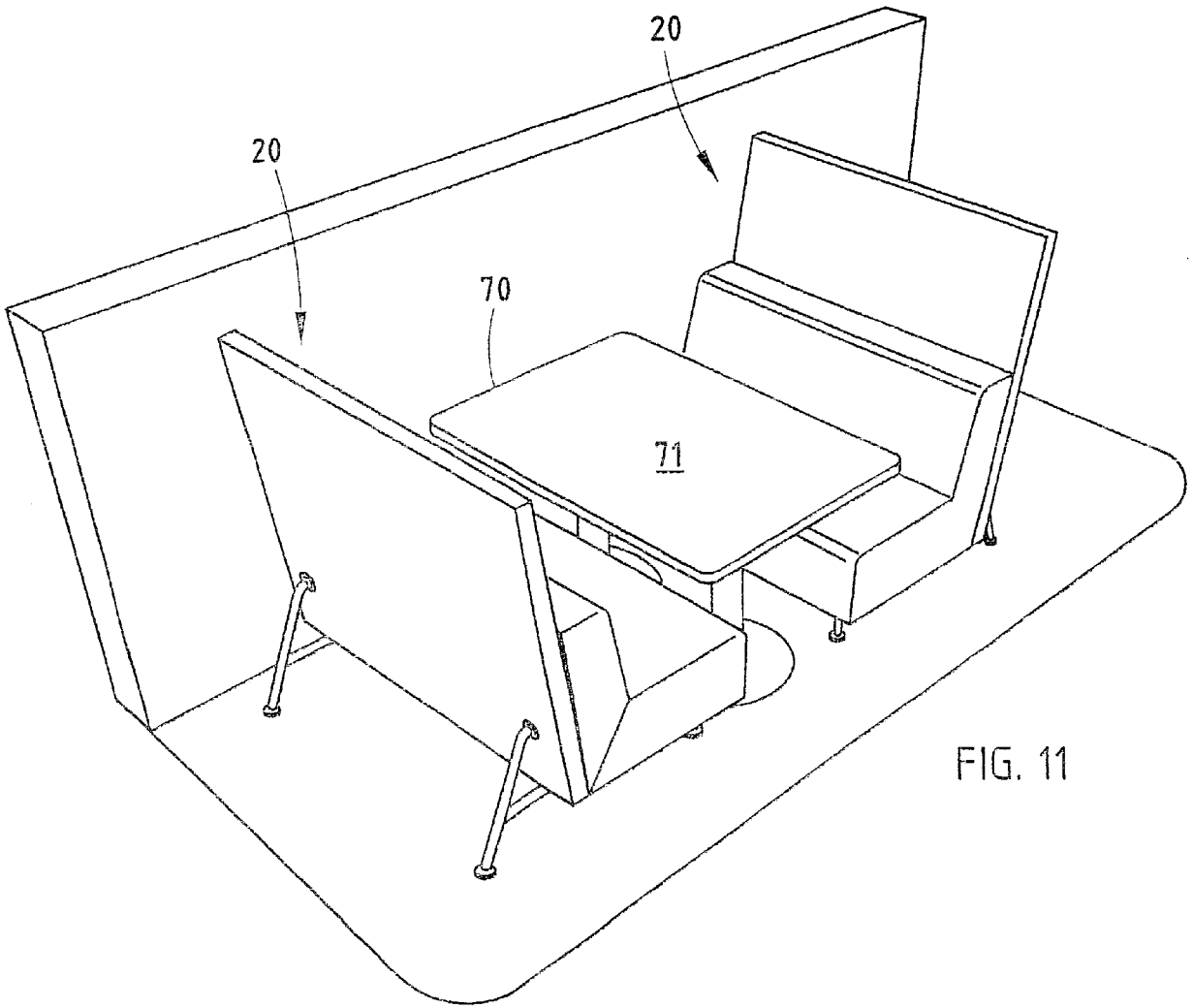
FIGS. 11 and 12 are perspective views of two different furniture arrangements that incorporate the seating unit assemblies of FIGS. 1 and 10.

It is noted that the back screen 27 provides significant privacy for a person seated in the seating unit assemblies 20. This privacy is further extended through use of adjacently-positioned seating unit assemblies 20 with back screens 27. For example, as shown in FIG. 11, a pair of the linear seating unit assemblies 20 can be positioned on opposite sides of a table 70 to form a booth-like arrangement. The booth arrangement can be positioned next to an office partition or wall for additional privacy. The booth arrangement as shown is highly usable in an office common area, for example, where it is desirable to continue an architectural appearance, yet provide privacy and/or an invitation to group discussion. The illustrated table 70 has a rectangular top 71, which further is consistent with an architectural theme.

Figure 12:
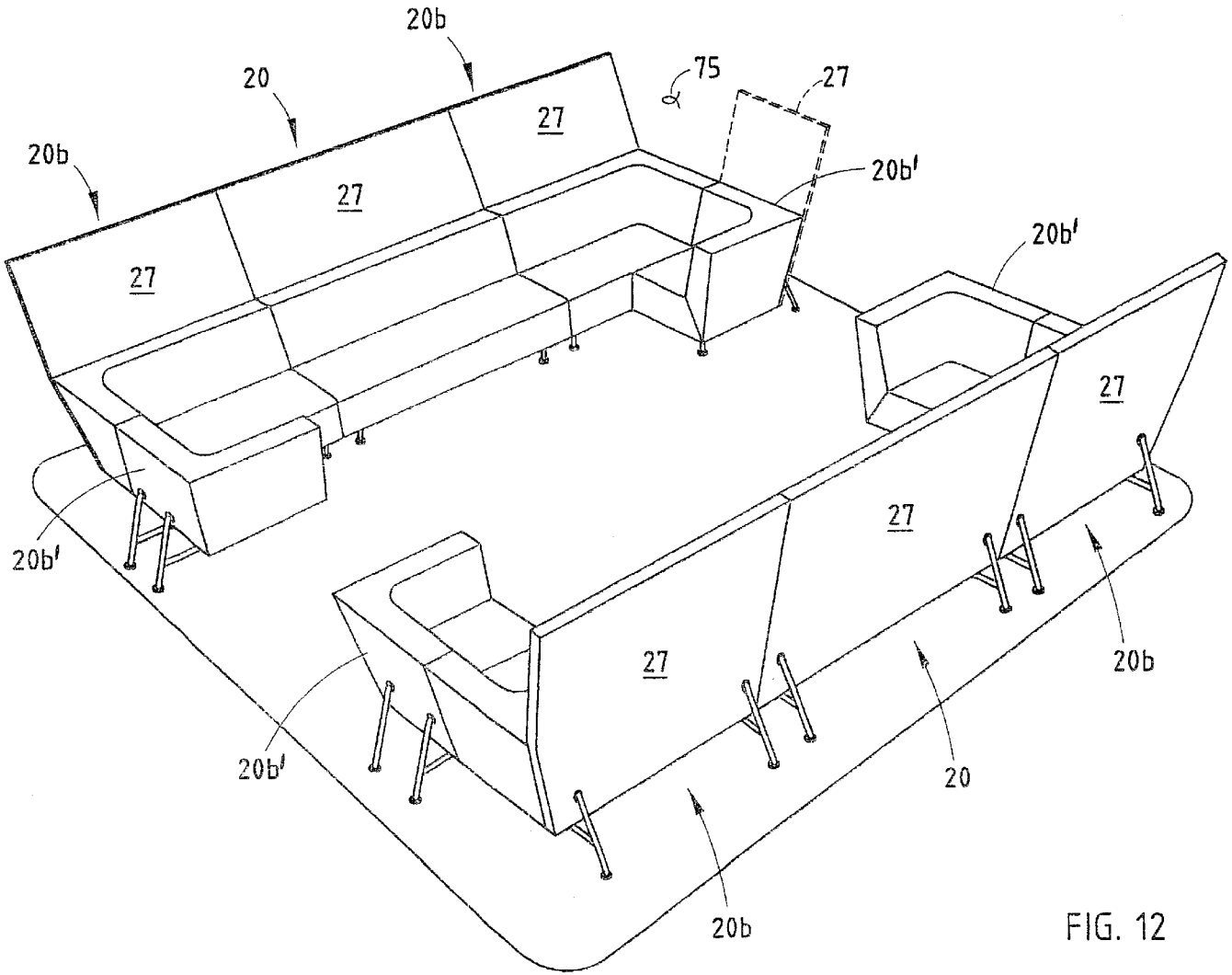

FIG. 12 illustrates a larger furniture arrangement, such as may be used in an airport waiting area or larger office building. The arrangement utilizes one linear seating unit assembly 20, two back-screened corner seating unit assemblies 20B, and two no-screen corner seating unit assemblies 20B' to form a well-defined and semi-enclosed area. More specifically, one linear seating unit assembly 20 is positioned between two corner seating unit assemblies 20B, with each having a back screen 27 attached. The back screens 27 form a continuous visual shield across a back of the row of seating unit assemblies 20 and 20B. One additional corner seating unit assembly 20B' is positioned at each end to close off the ends. These additional corner seating unit assemblies 20B' do not include any back screens 27, such that they provide a more open appearance on the ends of the row. The seating unit assemblies 20, 20B and 20B' form an elongated C-shaped arrangement. By positioning another similar arrangement in front of the first such furniture arrangement, a well-defined area is formed where a person coming into the area can easily see who is in the area, but where the "new" person cannot see over the back screens. In yet another arrangement (see the dashed lines in FIG. 12), two corner units can be provided with back screens 27 (see dashed lines), but an opening 75 still occurs to provide a controlled level of viewing into the area of concern.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit assembly comprising:

a seating unit;

a leg engaging a bottom and a back of the seating unit, the leg including a protruding attachment member that releasably engages a pocket in the seating unit when the leg is attached to the seating unit; and at least one fastener attaching the leg to the seating unit at a location spaced from the protruding attachment member so that, when the fastener is installed, the protruding attachment member cannot be removed from the pocket, but when the fastener is removed, the protruding attachment member can be removed from the pocket, whereby the protruding attachment member and pocket form part of a retaining structure for retaining the seating unit to the leg.

2. The seating unit defined in claim 1, including a back screen attached to one of the back and the leg.

3. A seating unit assembly comprising:

a seating unit;

a leg engaging a bottom and a back of the seating unit, the leg including a protruding attachment member that releasably engages a pocket in the seating unit when the leg is attached to the seating unit;

at least one fastener attaching the leg to the seating unit at a location spaced from the protruding attachment member so that, when the fastener is installed, the protruding attachment member cannot be removed from the pocket, whereby the protruding attachment member and pocket form part of a retaining structure for retaining the seating unit to the leg; and a back screen attached to one of the back and the leg, the back screen including an aperture that receives the protruding attachment member.

4. The seating unit defined in claim 3, wherein the seating unit includes a back portion and a seat portion, and wherein the back screen is positioned abuttingly flat against a rear surface of the back portion.

5. The seating unit defined in claim 1, wherein the seating unit includes a back portion, and including a back screen having a front surface positioned against a rear surface of the back portion, the back screen extending above the back portion.

6. The seating unit defined in claim 1, wherein the leg includes a first section positioned under and supporting the seating unit, and further includes an upright section having the attachment section thereon.

7. The seating unit defined in claim 1, including a second leg spaced from the first-mentioned leg and attached to the seating unit for supporting the seating unit.

8. The seating unit defined in claim 1, including a back screen attached to the seating unit, the back screen including an enlarged flat portion that extends above the seating unit and that provides a visual screen to people located behind a seated user.

9. A seating unit assembly comprising:

a seating unit having an upright back with a rear surface;

a leg supporting the seating unit and attached to the seating unit; and a back screen engaging the rear surface of the seating unit and retained, at least in part, by a protruding attachment member on the leg that extends horizontally through a hole in the back screen, the back screen extending upwardly from a rear of the seating unit so that the back screen visually shields a seated person in the seating unit when the seating unit is viewed from a position behind the chair.

10. The seating unit defined in claim 9, wherein the back screen comprises a flat panel.

11. The seating unit defined in claim 9, wherein the seating unit includes a back portion, and wherein the back screen lies flat against a rear surface of the back portion.

12. A seating unit assembly comprising:

a seating unit;

a leg supporting the seating unit and attached to the seating unit; and a back screen attached to the seating unit and retained, at least in part, by the leg, the back screen extending upwardly from a rear of the seating unit so that the back screen visually shields a seated person in the seating unit when the seating unit is viewed from a position behind the chair;

wherein the leg is removably attached to the seating unit by fasteners located in a single location on the leg and by a protruding attachment member on the leg that is spaced from the single location and that engages the seating unit.

13. The seating unit defined in claim 12, wherein the protruding attachment member extends through a hole in the back screen.

14. The seating unit defined in claim 12, wherein the back screen is removably attached to the leg.

15. A method comprising steps of:

providing a seating unit with a back portion having a rear surface; and positioning a back screen against the rear surface of the back portion and attaching the back screen with a protruding attachment member that extends through the back screen and through the rear surface into the back portion, with the back screen extending above the back portion to create a visual screen that separates a seated user from persons behind the seating unit.

16. The method defined in claim 15, wherein the step of attaching the back screen includes removably attaching the back screen.

17. The method defined in claim 15, including providing a leg on the seating unit, the leg having an underseat portion and an upright portion, at least one of which includes the a protruding attachment member at least one fastening member, and wherein attaching the back screen includes positioning the back screen between the back portion and an upright portion of the leg.

18. A seating unit assembly comprising:

a seating unit;

a leg engaging a bottom and a back of the seating unit, the leg including a protruding attachment member that releasably engages a pocket in the seating unit when the leg is attached to the seating unit; and at least one fastener attaching the leg to the seating unit at a location spaced from the protruding attachment member so that, when the fastener is installed, the protruding attachment member cannot be removed from the pocket, whereby the protruding attachment member and pocket form part of a retaining structure for retaining the seating unit to the leg.

* * * * *